US005619754A

United States Patent [19]

Thurwanger et al.

[11] Patent Number: 5,619,754

[45] Date of Patent: Apr. 15, 1997

[54] PROTECTIVE CAP WITH REVERSIBLE HEADBAND

[75] Inventors: Gary J. Thurwanger, Springfield; Barry P. Durham, Brookhaven, both of Pa.

[73] Assignee: Fibre-Metal Products, Co., Concordville, Pa.

[21] Appl. No.: 387,341

[22] Filed: Feb. 13, 1995

[51] Int. Cl.[6] ..... A42B 3/00

[52] U.S. Cl. ..... 2/418; 2/416

[58] Field of Search ..... 2/410, 416, 417, 2/418, 419, 420, 421, 422, 8

[56] References Cited

U.S. PATENT DOCUMENTS

| | | | |
|---|---|---|---|
| 2,342,501 | 2/1944 | Strauss | 2/417 |
| 3,354,468 | 11/1967 | Bowers . | |
| 3,387,304 | 6/1968 | Simpson et al. . | |
| 3,388,405 | 6/1968 | Simpson et al. . | |
| 3,513,481 | 5/1970 | Nickerson | 2/418 |
| 3,852,821 | 12/1974 | Mickel | 2/421 |
| 4,263,679 | 4/1981 | Erlendson . | |
| 4,888,831 | 12/1989 | Oleson | 2/420 |
| 4,942,628 | 7/1990 | Freund . | |

OTHER PUBLICATIONS

Jackson Brochure, p. 6., date unknown.

*Primary Examiner*—Michael A. Neas
*Attorney, Agent, or Firm*—Connolly & Hutz

[57] ABSTRACT

A protective cap comprises a rigid shell with a peak at the front of the shell. A sweatband is mounted within the shell. A headband is mounted to the sweatband in a free pivotal manner so that the position of the headband can be moved to the front or the rear of the shell thereby permitting the cap to be worn with the peak in the front or the peak in the rear. The mounting of the headband to the sweatband and the structural features of the headband and sweatband maximize the ease and comfort in permitting the wearing of the cap to be alternated between normal and reversed positions.

23 Claims, 2 Drawing Sheets

PROTECTIVE CAP WITH REVERSIBLE HEADBAND

BACKGROUND OF THE INVENTION

Protective caps are generally used and required in work areas where the user is subjected to the possibility of being struck by objects. Generally, such protective caps are in the form of a hard shell with a peak at the front of the shell. Proper use of the cap would have the cap level and the head of the user in the shell as deep as possible for proper protection from impact while still permitting visibility. A suspension is generally mounted within the shell to absorb energy from an impact, while a headgear in the shell aids in the proper fit. Frequently a sweatband is also provided in the shell to contact the user's head. A further conventional component is a headband which is mounted to the sweatband and extends to the rear of the shell for engagement at the nape of the neck at the back of the user's head. Reference is made to U.S. Pat. No. 5,319,808 which describes a protective cap particularly effective for impact absorbing such as by including spaced energy distributing points around the lower periphery of the shell.

There are times when it is necessary or desired to reverse the position of the cap so that the peak is in the rear and not at the front. This reversal of position would be done when the user wears other equipment at the front such as a welding helmet, face shield and goggles. A reversal of the position of the cap might also be desired in certain work instances where the user wishes to get as close as possible to the work and thus not have the peak interfere with such close working. Safety officials, in fact, often require that additional protection, such as welding helmets, face shields and goggles be mounted on an appropriate protective cap. When used with certain eye and face protection a protective cap should be worn in the reverse position with the peak in the rear. This position provides the greatest degree of protection, balance and stability where such eye/face protection is used.

Recently some safety officials have expressed concern about employees continuing to wear their protective caps in the reverse position after the eye and face protection has been removed. By continuing to wear the cap in the reverse position, the protection which would be afforded at the front from the rigid peak is negated.

Traditional protective caps require the user to reverse the headband within the cap to wear it properly in the rear position. The process must be reversed to put the cap back into the peak front position.

it would be desirable if a protective cap could be provided wherein the headband itself may be moved from one position to another to thereby facilitate the reversal in the wearing position of the cap. The concept of providing a headband or nape strap which can be moved to different positions is not new. Bowers, U.S. Pat. No. 3,354,468, for example, discloses a nape strap which could be mounted in different positions by the selective engagement of mounting elements on the nape strap with corresponding elements on the sweatband which is referred to as a headband in the '468 Bowers patent. A purpose of being able to change the mounting position of the nape strap is to provide the ability to mount the nape strap in a conventional wearing position or to mount it stored within the shell.

A commercial protective cap marketed under the name TRIPLE CROWN by Jackson Products includes a suspension that allows the cap to be worn turned about with the bill or peak in the back without having to reverse the system. This cap adjusts to three crown heights and includes a soft vinyl cushion that goes completely around the head. The nape strap is reversibly attached. To accomplish this reversible attachment of the nape strap, the nape strap is completely disengaged and then re-secured.

It has been suggested to the assignees of this application that a reversible protective cap could be provided by pivotally mounting the headband or nape strap. A prototype was made wherein a headband or nape strap was mounted to the inside of the sweatband (i.e. with the sweatband between the shell and headband). The pivotal mounting was off-center in that it was closer to one end of the cap than the other. Additionally, a nape strap or headband was used of conventional construction wherein accommodating recesses were provided at only one location at each end of the headband. Further, in the prototype a conventional sweatband was used wherein the padding did not extend completely around the sweatband. As the result, with this prototype it was necessary to readjust the length of the headband when the position of the cap was reversed. Moreover, when the cap was worn with the peak at the rear, there was no padding in the desired locations of the sweatband and there was interference with the ears by the headband due to the lack of ear accommodating structure in the reverse position and because the headband was mounted closer to the head than the sweatband at its mounting location.

SUMMARY OF THE INVENTION

An object of this invention is to provide a protective cap which includes a reversibly mounted headband to permit the wearing position of the cap to be reversed with minimal time and effort required by the wearer.

A further object of this invention is to provide such a protective cap which permits conversion from the normal to the reverse wearing positions and back in a quick and easy manner without having to remove, reverse and reinstall the suspension or the headband.

A still further object of this invention is to provide such a protective cap wherein maximum protection and comfort is achieved in either the normal or reverse wearing positions.

In accordance with this invention a protective cap is provided which includes a headband freely mounted to the sweatband at radial locations which bisect the sweatband so that in effect the pivotal mounting is at dead center of the sweatband. This permits the wearing position to be reversed without requiring any adjustment to the headband. Accordingly, the invention particularly lends itself to use of a ratchet headband wherein the initial adjustment of the headband length is made by manipulating the ratchet for the first wearing of the protective cap and then further manipulations of the ratchet are not required when the wearing position is reversed.

A further feature of this invention is the provision of padding completely around the sweatband rather than reversing the padding when the entire headgear is removed and reversed as is conventionally done. In addition, the headband is mounted to the sweatband between the sweatband and the shell so that the sweatband effectively contacts the head of the user even at the location of the headband mounting regardless of which wearing position is used.

A still further feature of this invention is to symmetrically shape both edges of the headband so that ear accommodating recesses are provided on each edge at each end of the headband. Thus, resulting in the avoidance of interference from the ears regardless of which wearing position is used.

DETAILED DESCRIPTION

Figure 1:
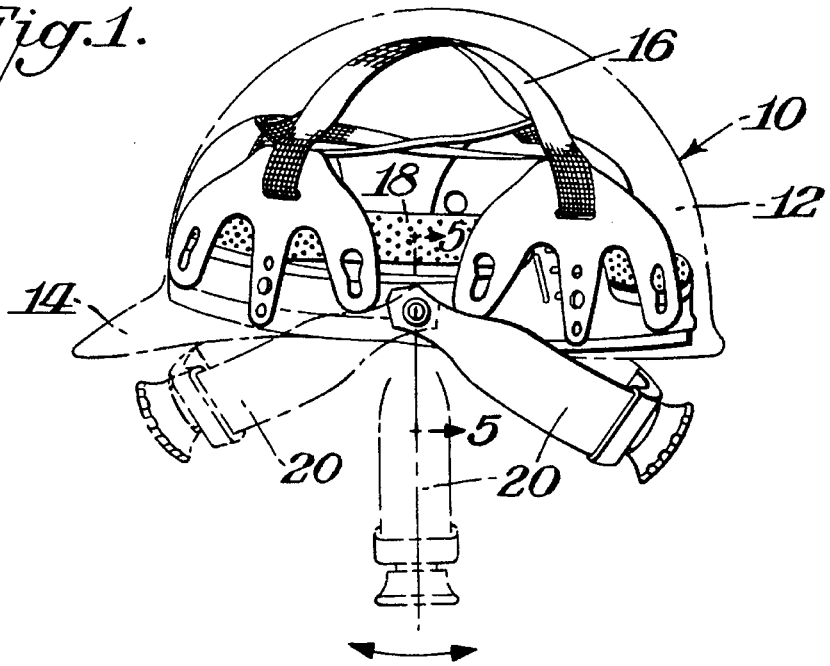
FIG. 1 is a side elevational view showing a protective cap in accordance with this invention with the headband illustrated in different positions and with shell and peak shown in phantom.

The present invention is directed to improvements in protective cap structure and more particularly in the ability to wear the protective cap in the normal position with the peak in the front or in the reverse position with the peak in the back. Reference is made to U.S. Pat. No. 5,319,808, the details of which are incorporated herein by reference thereto for the structure of a known protective cap. As shown in FIG. 1 herein, the cap 10 includes a rigid shell 12 with a rigid peak 14 extending outwardly from the front of the shell 12. A suspension 16 is mounted within the shell. Additionally, a sweatband 18 is mounted in the shell along the lower periphery of the shell. A headband or nape strap 20 is secured to the sweatband 18.

Figure 7:
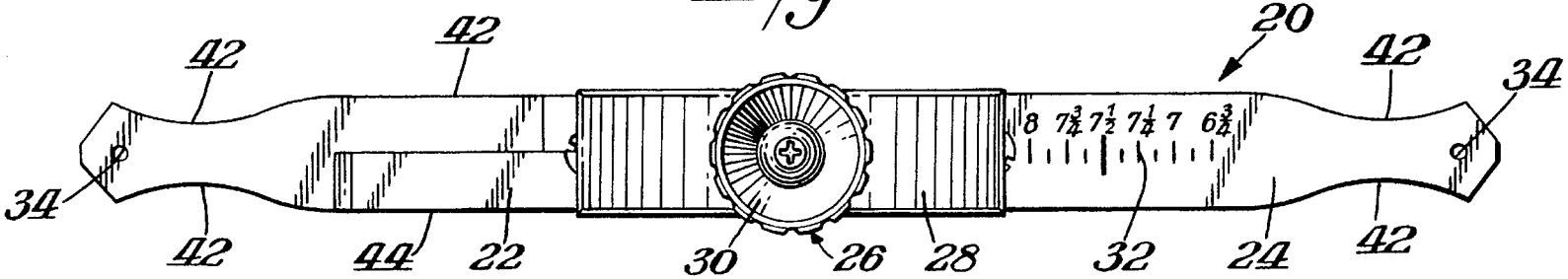
FIG. 7 is a top plan view of the headband shown in FIG. 6.
Figure 6:
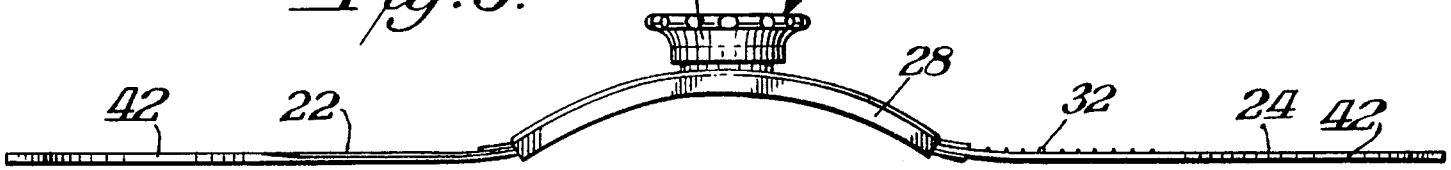
FIG. 6 is a side elevational view of the headband itself used with the protective cap shown in FIGS. 1–5.

As shown in FIGS. 6–7, headband 20 is comprised of two separate strap members 22,24 which are adjustably secured to each other by a ratchet mechanism 26. The utilization of a ratchet mechanism to adjust the overall length of the headband is known and is incorporated, for example, in various protective caps manufactured by Fibre-Metal Products Co. of Concordville, Pa. Generally, the length adjustment is achieved by providing each strap 22,24 with an elongated hole having teeth formed along an edge of the hole. The straps are telescoped into a housing 28 in an overlapping fashion with a ratchet member engaged in the teeth of the overlapped holes. By rotating knob 30 the ratchet member causes the straps to move toward or away from each other in the known manner. If desired, indicia 32 could be provided on one of the straps to indicate the overall length or head size that results from manipulation of the ratchet mechanism 26.

Figure 5:
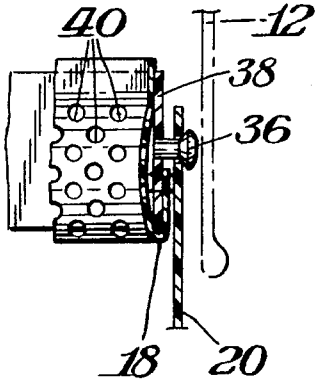
FIG. 5 is a cross-sectional view taken through FIG. 1 along the line 5–5.
Figure 4:
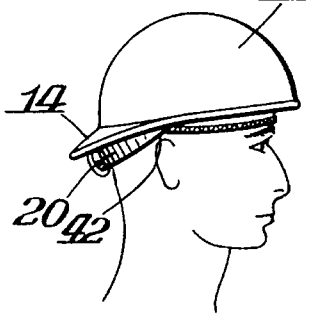
FIG. 4 is a side elevational view of the protective cap shown in FIGS. 1 and 3 in the reverse wearing position.

In accordance with this invention headband 20 is mounted in a free pivoting manner to sweatband 18. The location of mounting is such that the closed loop formed by sweatband 18 and the shell 12 are, in effect, bisected by an imaginary line extending from the point of mounting one end of headband 20 to the point of mounting the other end of headband 20. Thus, each end of headband 20 is mounted along a radius extending through the center of the closed loop. Any suitable means of mounting could be used. preferably, however, the mounting simply results from providing a through hole 34 at each end of headband 20. A pivot pin or button 36 extends through the through hole and is secured to sweatband 18 as best illustrated in FIG. 5. By this free mounting, if the cap is raised where it does not contact the wearer's head, the headband 20 will hang straight downwardly as shown in phantom in FIG. 1.

Because of the free pivotal mounting it is possible to readily move the headband to either the rear or front of the cap by either tilting the cap in the proper direction or by applying a slight force to the headband either from contact with the head or hand of the user. Thus, the headband 20 could be mounted at the rear of the cap remote from the peak 14 as shown in solid lines in FIG. 1 or could be mounted at the front of the cap below the peak 14 as shown in phantom in FIG. 1.

As shown in FIG. 1 portions of the longitudinal side edges of the headband 20 contact the sweatband 18 during the pivotal movement of the headband. When a respective edge contacts the sweatband the headband can no longer rotate in that direction. As illustrated in the various figures, including FIG. 1, the headband 20 is symmetrically shaped in that its edges and more particularly the portions of its edges which contact the sweatband on each edge extend the same distance from an imaginary line extending from pivot point to pivot point across the headband 20. FIG. 1, for example, shows the headband 20 in the straight downward or intermediate position which illustrates such an imaginary line as bisecting the headband with each side edge extending the same distance from the bisecting imaginary line as the other side edge.

Figure 2:
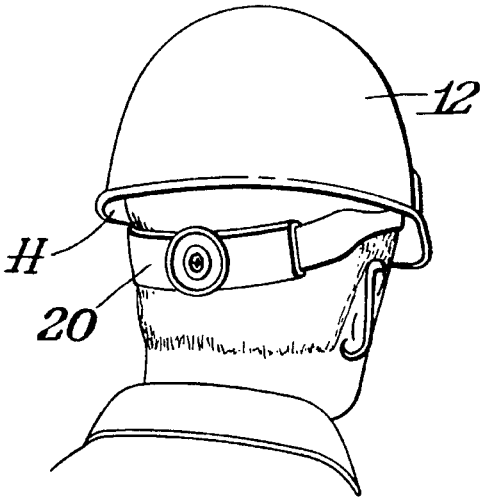
FIG. 2 is a rear elevational view of the protective cap shown in FIG. 1 in the normal wearing position.
Figure 3:
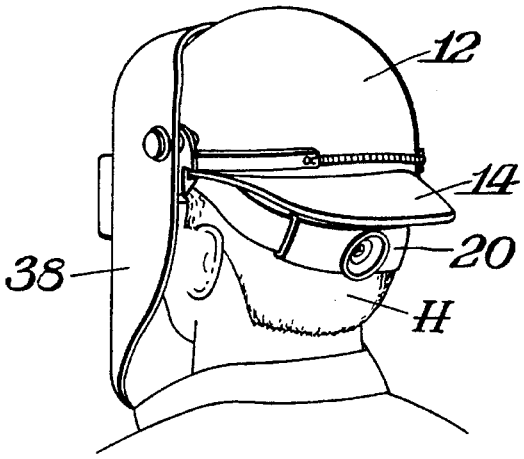
FIG. 3 is a rear elevational view of the protective cap shown in FIG. 1 in the reverse wearing position.

Because of the ability to dispose the headband in either the front or rear of the cap it is possible to wear the cap in a normal wearing position shown in FIG. 2 where the cap is mounted on the head H of the wearer or in a reverse position, such as shown in FIG. 3, where the headband is under the peak 14. The reverse position permits the wearer to use a welding helmet 38 or other equipment, such as goggles and other eye or face protection.

By mounting the headband dead center with respect to the closed loop sweatband, it is not necessary to make any readjustments of the length of the headband, such as by requiring further manipulations of the ratchet mechanism 26. Additionally, the free pivotal mounting permits movement of the headband without requiring any detachment of any cap elements, such as detaching the sweatband and/or assembly and/or headband. Moreover, the reversing of the location of the headband can be simply achieved by raising the cap with one hand until the headband clears the head and then by again lowering the cap after there has been the desired change in orientation of the headband in the manner previously described. All of this could be done with one hand. This feature provides a number of significant advantages over prior arrangements which require the user to completely remove the cap and to utilize two hands for the manipulations necessary to permit cap reversal. In such prior practices if these manipulations are done in the work area the user's head is exposed for the period of time that the manipulations take place which defeats the purpose of having a protective cap. Accordingly, what is generally done is that the user would leave the work area to make the necessary manipulations. When a user leaves the work area it has been found that the user does not immediately return, but rather uses the opportunity of leaving the work area for taking work breaks. All of these disadvantages are avoided by the manner in which the headband is mounted to the sweatband in accordance with this invention.

The invention also takes into account the structure which would be desired to the headband and sweatband as a result of the reversal of cap position. Conventionally, sweatbands are not padded in the front area of the cap. If a conventional sweatband were used with a reversibly mounted headband, the result would be that the rear of the head would not have a padded sweatband, thus detracting from the comfort generally desired of sweatbands. In accordance with this invention the sweatband 18 is provided with a padding 38 throughout its length. Preferably sweatband 18 includes ventilation holes 40.

A further feature of this invention is the provision of ear accommodating recesses 42 on each of the opposed edges 44,46 of the headband near the free ends of the headband. Frequently, a protective cap is worn with the headband very close to the user's ears. In order to prevent interference from the ears the recess 42 provides clearance to accommodate the ears. By symmetrically forming the ends of headband 20 with four recesses 42, the ears are accommodated regardless of whether the headband is worn in the normal position of FIG. 2 or in the reverse position of FIG. 3.

Another feature of the invention is that the headband 20 is mounted to the sweatband 18 between the shell 12 and the sweatband 18. As a result, the sweatband 18 can directly contact the user's head at all of the necessary areas including the locations of the mounting of the headband to the sweatband.

It is to be understood that all of the above features of the invention, while desirable, need not be included in a protective cap in accordance with the broad practices of the invention. Thus, individual or combinations of the features may be included while other features may be omitted with the realization that the advantages of the omitted features will likewise be omitted. For example, one of the significant features of the invention is the free pivotal mounting of the headband at dead center with respect to the sweatband. If desired, however, instead of a free pivotal mounting a type of mounting may be used which locks the headband at its desired positions. Additionally, if, for some reason it is not considered a disadvantage to readjust the ratchet mechanism or if some other type of headband is used wherein length adjustability is either not required or does not require manipulation, then the location of the headband mounting need not be at dead center of the sweatband.

By use of the invention the wearer simply swings the headband 20 to the front or rear of the cap depending on whether or not eye and/or face protection are to be mounted on the cap. When the additional protective equipment is no longer needed, the wearer simply swings the headband back to the normal wearing position, rotates the cap with the peak in the front and continues working with no down time. The invention, also provides exceptional comfort because of the 360° padded perforated sweatband with head hugging stability and easy adjustment of the ratchet headband. This is especially beneficial when the weight of a welding helmet, faceshield or goggle is added to a protective cap.

By utilizing the headband with the Supereight™ protective cap of Fibre-Metal Products Co., it is possible for the headband to be raised, lowered, tilted or moved from front to rear for just the right fit or feel. The full, padded, perforated sweatband provides cushioning around the head and helps cool the air circulating within the cap.

The protective cap of this invention would comply with OSHA regulations for head protection and be SEI Certified to comply with ANSI protective cap standards when worn in either the peak front or peak rear positions. Wearing the cap 10 in the rear as shown in FIG. 3 positions the welding helmet, face shield or goggles as close to the face as possible and covers the maximum exposed face and neck area. This is a distinct advantage over devices which do not utilize the invention and which are jury-rigged for front-mounting over the peak, causing "tunnel vision" in welding helmets, distortion in face shields and exposing the eye and face to hazards by extending the protective devices away from the eyes.

The cap 10 of this invention thus gives the wearer the option of wearing the cap in the front or rear position and the ability to convert the headband from one position to the other easily and quickly.

What is claimed is:

1. In a protective cap comprising a rigid shell for covering the head of the wearer, a peak extending outwardly from said shell to define the front of said cap, the rear of said cap being directly opposite to said peak, a sweatband in said shell for fitting against the head of the wearer, and a headband mounted to said sweatband for fitting against the back of the neck of the wearer, the improvement being in that said headband is pivotally mounted to said sweatband in a free swinging manner whereby said headband may readily swing selectively toward said front of said cap and toward said rear of said cap to selectively permit said cap to be worn with said peak at the front of the head of the wearer and at the back of the head of the wearer, said headband being mounted to said sweatband on opposite sides of said sweatband along an imaginary line bisecting said sweatband whereby the wearing position of said cap may be reversed without requiring any adjustment to said headband so that once said cap is properly fitted for the head of the user the fit remains proper even when the wearing position of said cap is reversed, said headband including a pair of ends with interconnecting side edges, each of said ends being pivotally mounted to said sweatband, each of said side edges including an ear accommodating recess generally located at each of said ends, and said side edges being symmetrically shaped at said ends to provide identical ear accommodating recesses.

2. The cap of claim 1 wherein each of said ear accommodating recesses is concavely shaped, each of said ends having a through hole, and each of said ends being mounted to said sweatband by a pivot pin extending through said through hole.

3. The cap of claim 2 wherein said headband is adjustable in length.

4. The cap of claim 3 wherein said headband comprises two straps interconnected by a ratchet mechanism for providing the length adjustability of said headband.

5. The cap of claim 4 wherein said sweatband is in the form of a closed loop, and said sweatband being padded completely around said loop.

6. The cap of claim 5 wherein said headband is mounted between said sweatband and said shell to permit said sweatband to directly contact the head of the wearer at the location of mounting of said headband to said sweatband.

7. The cap of claim 1 wherein said headband comprises two straps interconnected by a ratchet mechanism for providing length adjustability of said headband.

8. The cap of claim 1 wherein said headband comprises two straps interconnected by a ratchet mechanism for providing length adjustability of said headband.

9. The cap of claim 1 wherein said headband is mounted between said sweatband and said shell to permit said sweatband to directly contact the head of the wearer at the location of mounting of said headband to said sweatband.

10. In a protective cap comprising a rigid shell for covering the head of the wearer, a peak extending outwardly from said shell to define the front of said cap, the rear of said cap being directly opposite to said peak, a sweatband in said shell for fitting against the head of the wearer, and a headband mounted to said sweatband for fitting against the back of the neck of the wearer, the improvement being in that said headband is pivotally mounted to said sweatband in a free swinging manner whereby said headband may readily swing selectively toward said front of said cap and toward said rear of said cap to selectively permit said cap to be worn with said peak at the front of the head of the wearer and at the back of the head of the wearer, and said headband including a pair of ends with interconnecting side edges, each of said ends being pivotally mounted to said sweatband, each of said side edges including an ear accommodating recess generally located at each of said ends, and said side edges being symmetrically shaped at said ends to provide identical ear accommodating recesses.

11. The cap of claim 10 wherein each of said ear accommodating recesses is concavely shaped, each of said ends having a through hole, and each of said ends being mounted to said sweatband by a pivot pin extending through said through hole.

12. The cap of claim 11 wherein said headband is adjustable in length.

13. The cap of claim 12 wherein said headband comprises two straps interconnected by a ratchet mechanism for providing the length adjustability of said headband.

14. The cap of claim 10 wherein said headband comprises two straps interconnected by a ratchet mechanism for providing length adjustability of said headband.

15. In a protective cap comprising a rigid shell for covering the head of the wearer, a peak extending outwardly from said shell to define the front of said cap, the rear of said cap being directly opposite to said peak, a sweatband in said shell for fitting against the head of the wearer, and a headband mounted to said sweatband for fitting against the back of the neck of the wearer, the improvement being in that said headband is mounted to said sweatband for being selectively positioned at said front of said cap and at said rear of said cap to permit said cap to be worn in a normal position with said peak at the front of the head and in a reverse position with said peak at the back of the head, said headband including a pair of ends with interconnecting side edges, each of said ends being pivotally mounted to said sweatband, each of said side edges including an ear accommodating recess generally located at each of said ends, said side edges being symmetrically shaped at said ends to provide identical ear accommodating recesses, each of said ear accommodating recesses being concavely shaped, each of said ends having a through hole, and each of said ends being mounted to said sweatband by a pivot pin extending through said through hole.

16. A reversible headband for use with a protective cap for permitting the protective cap to be selectively worn in a normal position with its peak in the front and in a reverse position with its peak in the rear, said headband comprising a pair of strap members, adjusting means connecting said strap members together for adjusting the overall length of said strap member, said strap members having a pair of opposite ends interconnected by side edges, pivot structure at each of said ends for permitting said strap member to be pivotally mounted to the cap at each of said ends, each of said side edges including an ear accommodating recess generally located at each of said sides, and said side edges being symmetrically shaped at said ends with respect to each other to provide identical ear accommodating recesses.

17. The headband of claim 16 wherein each of said ear accommodating recesses is concavely shaped, said pivot structure being a through hole in each of said ends, and said adjusting means being a ratchet mechanism.

18. A method of wearing a protective cap having a rigid shell for covering the head of the wearer and a peak extending outwardly from the shell at the front of the cap and with a sweatband mounted within the shell and having a headband connected to the sweatband comprising the steps of pivotally mounting the headband to the sweatband in a free swinging manner, placing the cap on the head of the wearer with the peak extending outwardly at the front of the head raising the cap from the head of the wearer and permitting the headband to swing in a direction toward the peak, reversing the location of the cap, lowering the cap onto the head of the wearer with the headband and peak at the back of the neck of the wearer, and again raising the cap from the head to return the headband and peak to their original positions to permit the cap to again be worn on the head of the wearer with the peak located at the front of the head.

19. The method of claim 18 including mounting protective eye and/or face equipment at the front of the user's head when the cap is worn with the peak disposed at the back of the user's head.

20. In a protective cap comprising a rigid shell for covering the head of the wearer, a peak extending outwardly from said shell to define the front of said cap, the rear of said cap being directly opposite to said peak, a sweatband in said shell for fitting against the head of the wearer, and a headband mounted to said sweatband for fitting against the back of the neck of the wearer, the improvement being in that said headband is pivotally mounted to said sweatband in a free swinging manner whereby said headband may readily swing selectively toward said front of said cap and toward said rear of said cap to selectively permit said cap to be worn with said peak at the front of the head of the wearer and at the back of the head of the wearer, said headband including a pair of ends with interconnecting longitudinal side edges, each of said ends being pivotally mounted to said sweatband at pivot points on diametrically opposite portions of said sweatband, each of said edges including sweatband contacting portions which contact said sweatband when said headband is pivoted back and forth, the contacting of said contacting portions against said sweatband limiting the extent of pivoting of said headband, said headband at said sweatband contacting portions being bisected by an imaginary line extending between said pivot points and longitudinally across said headband, said headband being pivotable toward said sweatband in a direction to said front of said cap the same distance as in a direction to said rear of said cap, and each of said side edges being symmetrically shaped at said sweatband contacting portions with said sweatband contacting portions being mirror images of each other and extending outwardly beyond said imaginary line the same distance as each other to permit said headband to be selectively pivoted while remaining attached to said sweatband for the selective reversible wearing of said cap.

21. The cap of claim 20 wherein each of said side edges includes an ear accommodating recess generally located at each of said ends.

22. The cap of claim 20 wherein said sweatband is in the form of a closed loop, and said sweatband being padded completely around said loop.

23. The cap of claim 20 wherein said headband is mounted between said sweatband and said shell to permit said sweatband to directly contact the head of the wearer at the location of mounting of said headband to said sweatband.

* * * * *